US010450517B2

(12) United States Patent
Umansky et al.

(10) Patent No.: US 10,450,517 B2
(45) Date of Patent: Oct. 22, 2019

(54) PRODUCTION OF UPGRADED EXTRACT AND RAFFINATE

(71) Applicant: ExxonMobil Research and Engineering Company, Annandale, NJ (US)

(72) Inventors: Benjamin S. Umansky, Fairfax, VA (US); Keith K. Aldous, Montgomery, TX (US); James W. Gleeson, Magnolia, TX (US); Edward J. Blok, Huffman, TX (US); Richard A. Demmin, Highland Park, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 15/599,636

(22) Filed: May 19, 2017

(65) Prior Publication Data

US 2017/0342330 A1 Nov. 30, 2017

Related U.S. Application Data

(60) Provisional application No. 62/341,167, filed on May 25, 2016.

(51) Int. Cl.

| | |
|---|---|
| ***C07C 7/10*** | (2006.01) |
| ***C07C 13/00*** | (2006.01) |
| ***C10G 45/10*** | (2006.01) |
| ***C10G 45/22*** | (2006.01) |
| ***C10G 45/72*** | (2006.01) |
| ***C10G 47/02*** | (2006.01) |
| ***C10G 49/26*** | (2006.01) |

(52) U.S. Cl.

CPC ..... *C10G 45/10* (2013.01); *C10G 45/22* (2013.01); *C10G 45/72* (2013.01); *C10G 47/02* (2013.01); *C10G 49/26* (2013.01); *C10G 2300/10* (2013.01); *C10G 2400/04* (2013.01); *C10G 2400/30* (2013.01)

(58) Field of Classification Search

CPC ..... C07C 7/10; C07C 13/00; C10G 2300/202; C10G 2300/304

See application file for complete search history.

(56) References Cited

U.S. PATENT DOCUMENTS

| | | | | |
|---|---|---|---|---|
| 3,705,093 | A * | 12/1972 | Ashcraft, Jr. | A61K 8/31 208/14 |
| 3,790,470 | A | 2/1974 | Mead et al. | |
| 4,008,149 | A * | 2/1977 | Itoh | B01J 23/88 208/216 PP |
| 4,770,763 | A | 9/1988 | Kusayanagi et al. | |
| 5,225,094 | A * | 7/1993 | Pillon | C10M 133/06 508/306 |
| 5,372,703 | A * | 12/1994 | Kamiya | C10M 101/02 208/14 |
| 5,925,234 | A | 7/1999 | Morel et al. | |
| 2013/0062256 | A1 | 3/2013 | Koseoglu | |

FOREIGN PATENT DOCUMENTS

| | | |
|---|---|---|
| GB | 2037806 A | 11/1979 |

OTHER PUBLICATIONS

The International Search Report and Written Opinion of PCT/US2017/033505 dated May 19, 2017.

* cited by examiner

*Primary Examiner* — Randy Boyer

(74) *Attorney, Agent, or Firm* — Scott F. Yarnell

(57) ABSTRACT

Systems and methods are provided for producing upgraded raffinate and extract products from lubricant boiling range feeds and/or other feeds having a boiling range of 400° F. (204° C.) to 1500° F. (816° C.) or more. The upgraded raffinate and/or extract products can have a reduced or minimized concentration of sulfur, nitrogen, metals, or a combination thereof. The reduced or minimized concentration of sulfur, nitrogen, and/or metals can be achieved by hydrotreating a suitable feed under hydrotreatment conditions corresponding to relatively low levels of feed conversion. Optionally, the feed can also dewaxed, such as by catalytic dewaxing or by solvent dewaxing. Because excessive aromatic saturation is not desired, the pressure for hydrotreatment (and optional dewaxing) can be 500 psig (~3.4 MPa) to 1200 psig (~8.2 MPa).

5 Claims, 1 Drawing Sheet

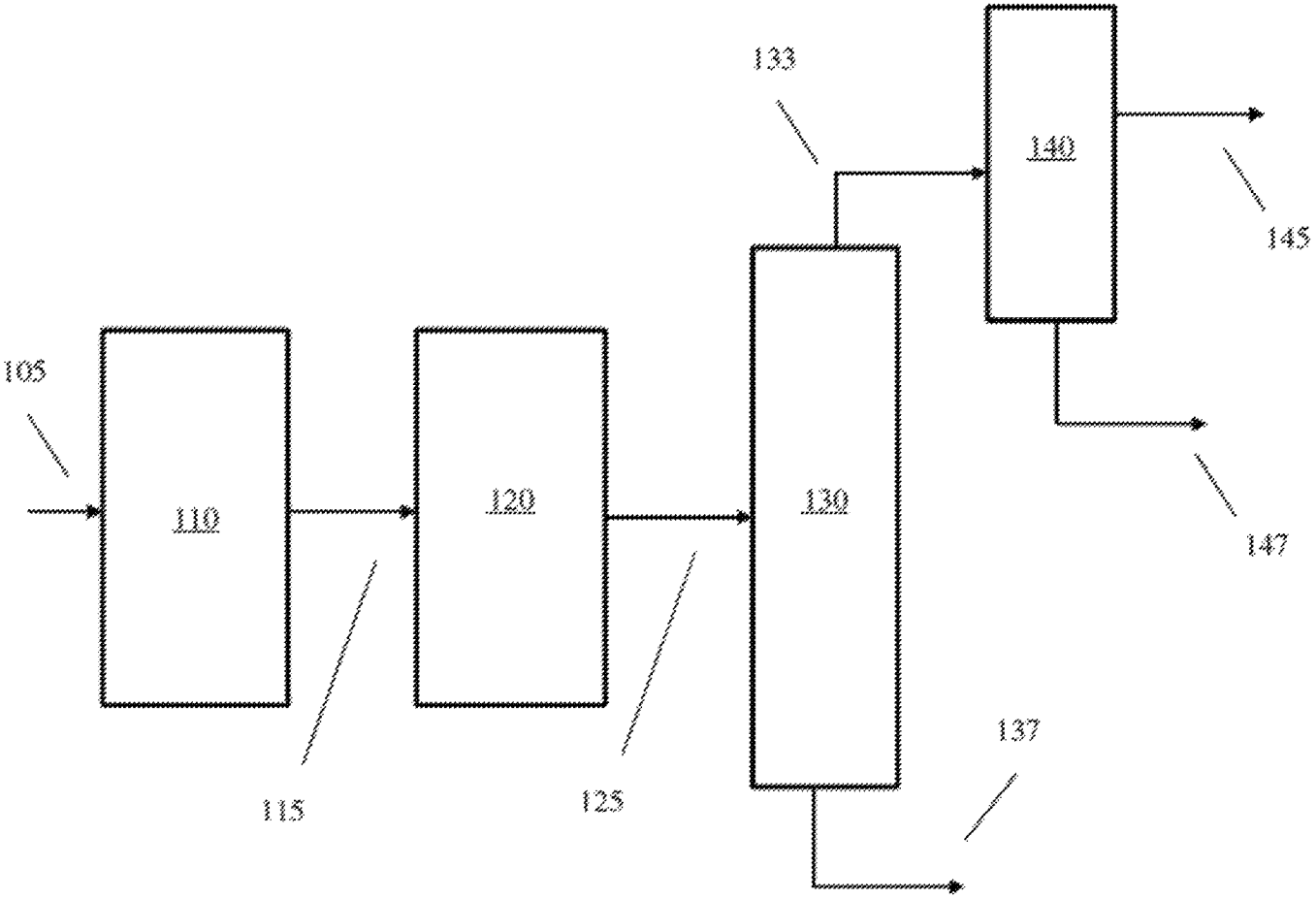
105
110
115
120
125
130
133
137
140
145
147

PRODUCTION OF UPGRADED EXTRACT AND RAFFINATE

CROSS-REFERENCE TO RELATED APPLICATIONS

This application claims priority to U.S. Provisional Application Ser. No. 62/341,167 filed May 25, 2016, which is herein incorporated by reference in its entirety.

FIELD

Systems and methods are provided for production of extract and raffinate fractions with reduced or minimized amounts of toxic compounds.

BACKGROUND

One of the products that can be generated during lubricant production via solvent processing is a high aromatic content extract product. The aromatic extraction process that generates the high aromatic content extract product is typically performed prior to hydrotreating of the lubricant feed. As a result, the high aromatic content extract product can also have elevated levels of sulfur, nitrogen, and/or metals. In some potential applications where a high aromatic content feed would be useful, the elevated levels of sulfur, nitrogen, and/or metals can pose difficulties for use of an aromatic extract product.

U.S. Pat. No. 3,790,470 describes a process for production of lubricating oils. The process includes hydrocracking of a suitable lubricant boiling range feedstock. The yield of hydrocracked oil (in the lubricant boiling range) is reported as being about 70% in an example. A solvent extraction is then performed on the hydrocracked effluent to produce a raffinate with reduced aromatic content and an extract with increased aromatic content. The extract is then exposed to catalytic hydrogenation conditions. The hydrogenated extract is then combined with the raffinate to improve the overall yield of lubricant base oil from the process. Although the viscosity index of the hydrogenated extract is relatively low, the viscosity index of the final lubricant base oil product is only modestly lower than the viscosity index of the raffinate.

SUMMARY

In an aspect, a method for forming a raffinate and an extract is provided. The method can include hydrotreating a feedstock having a T5 boiling point of at least 400° F. (~204° C.), or at least 650° F. (~343° C.), and a T95 boiling point of 1500° F. (~816° C.) or less, or 1200° F. (~649° C.) or less, under hydrotreating conditions. The hydrotreating conditions can be selected to correspond to provide less than 15% feed conversion (or less than 10% feed conversion) relative to a conversion temperature of 700° F. (~371° C.) to form a hydrotreated effluent. The feedstock can have a 650° F.+ (~343° C.+) aromatics content of 25 wt % to 90 wt % (or 30 wt % to 90 wt %) and/or a sulfur content of greater than 1000 wppm. The hydrotreated effluent can comprise a hydrotreated effluent fraction having a T5 boiling point of at least 400° F. (~204° C.) (or at least 650° F. (~343° C.)) and/or an aromatics content of at least 10 wt % and/or a sulfur content of less than about 1000 wppm and/or a combined amount of Ni, V, and Fe of less than 10 wppm. A solvent extraction can be performed on the hydrotreated effluent fraction to form at least a raffinate product having a nitrogen content of less than 50 wppm (or 25 wppm or less, or 10 wppm or less) and an extract product comprising at least 70 wt % aromatics. Optionally, the raffinate product can be solvent dewaxed.

In another aspect, a raffinate product is provided that has a pour point of 0° C. or less (or −9° C. or less). The raffinate product can include at least 55 wt % of total naphthenes. The raffinate product can further include 6 wt % to 15 wt % of 4+-ring naphthenes (or 6 wt % to 8 wt %) and/or less than 1000 wppm of sulfur and/or less than 50 wppm of nitrogen and/or less than 3.0 wt % of polycyclic aromatics. Optionally, the raffinate product can further include 9 wt % to 17 wt % of 3-ring naphthenes and/or 2 wt % to 20 wt % of total aroamtics.

In still another aspect, an extract product is provided. The extract product can include at least 70 wt % aromatics. The extract product can further include 15 wt % to 20 wt % of 4-ring aromatics and/or less than 15 wt % of 3-ring aromatics and/or less than 1000 wppm of sulfur. The extract product can have a T5 boiling point of at least 400° C. and/or a T95 boiling point of 560° C. or less. The extract product can optionally have a metals content of less than 10 wppm and/or a total naphthene content of 10 wt % to 20 wt %.

BRIEF DESCRIPTION OF THE DRAWINGS

FIG. 1 schematically shows an example of a configuration suitable for processing a feedstock to form a raffinate product and an extract product.

DETAILED DESCRIPTION

Overview

All numerical values within the detailed description and the claims herein are modified by "about" or "approximately" the indicated value, and take into account experimental error and variations that would be expected by a person having ordinary skill in the art.

In various aspects, systems and methods are provided for producing upgraded raffinate and extract products from lubricant boiling range feeds and/or other feeds having a boiling range of 400° F. (204° C.) to 1500° F. (816° C.) or more. The upgraded raffinate and/or extract products can have a reduced or minimized concentration of sulfur, nitrogen, metals, or a combination thereof. The reduced or minimized concentration of sulfur, nitrogen, and/or metals can be achieved by hydrotreating a suitable feed under hydrotreatment (relatively low conversion) conditions. Optionally, the feed can also dewaxed, such as by catalytic dewaxing or by solvent dewaxing. Because excessive aromatic saturation is not desired, the pressure for hydrotreatment (and optional dewaxing) can be 500 psig (~3.4 MPa) to 1200 psig (~8.2 MPa). This can reduce the required amount of hydrogen for processing a feed. The nature and use of the upgraded raffinate and/or extract products can be dependent in part on the nature of the feed.

Hydroprocessing is used herein to denote various processes involving treatment of a feed in the presence of hydrogen and include processes which involve at least one of boiling range reduction, removal of contaminants, viscosity reduction, viscosity index (VI) increase, pour point reduction and aromatics saturation. Examples of typical hydroprocessing schemes include hydrotreating, hydrocracking, hydrofinishing (a.k.a, hydrofining), hydrodewaxing, hydroisomerization, and raffinate hydroconversion.

Group I basestocks or base oils are defined as base oils with less than 90 wt % saturated molecules and/or at least 0.03 wt % sulfur content. Group I basestocks also have a viscosity index (VI) of at least 80 but less than 120. Group II basestocks or base oils contain at least 90 wt % saturated molecules and less than 0.03 wt % sulfur. Group II basestocks also have a viscosity index of at least 80 but less than 120. Group III basestocks or base oils contain at least 90 wt % saturated molecules and less than 0.03 wt % sulfur, with a viscosity index of at least 120. In addition to the above formal definitions, some Group I basestocks may be referred to as a Group I+ basestock, which corresponds to a Group I basestock with a VI value of 103 to 108. Some Group II basestocks may be referred to as a Group II+ basestock, which corresponds to a Group II basestock with a VI of at least 113. Some Group III basestocks may be referred to as a Group III+ basestock, which corresponds to a Group III basestock with a VI value of at least 140.

In this discussion, unless otherwise specified, references to a liquid effluent or a liquid product are references to an effluent or product that is a liquid at 25° C. and 100 kPa (~1 atm). In this discussion, the naphtha boiling range is defined as ~50° F. (~10° C., roughly corresponding to the lowest boiling point of a pentane isomer) to 350° F. (177° C.). The jet boiling range is defined as 284° F. (140° C.) to 572° F. (300° C.). The diesel boiling range is defined as 350° F. (177° C.) to 650° F. (343° C.). The lubricant boiling range is defined as 650° F. (343° C.) to 1200° F. (~650° C.). Compounds ($C_{4-}$) with a boiling point below the naphtha boiling range can be referred to as light ends.

The aromatics content in a lubricant base stock or other product can be determined by any convenient method. Commonly used methods include ASTM D2007, ASTM D7419, and IP 368. One option for determining the aromatics content of the lubricant base stock product can be to determine the aromatics content according to ASTM D2008. ASTM D2008 provides one example of a method for correlating data generated from UV/VIS spectroscopy with a weight of aromatics present in a sample. Alternatively, other methods for correlating data from UV/VIS spectroscopy with a weight of aromatics in a sample can also be used.

Reference is made to conversion of a feedstock relative to a conversion temperature T. Conversion relative to a temperature T is defined based on the portion of the feedstock that boils at a temperature greater than the conversion temperature T. The amount of conversion during a process (or optionally across multiple processes) is defined as the weight percentage of the feedstock that is converted from boiling at a temperature above the conversion temperature T to boiling at a temperature below the conversion temperature T. For example, consider a feedstock that includes 40 wt % of components that boils at 700° F. (371° C.) or greater. By definition, the remaining 60 wt % of the feedstock boils at less than 700° F. (371° C.). For such a feedstock, the amount of conversion relative to a conversion temperature of 700° F. (371° C.) would be based only on the 40 wt % that initially boils at 700° F. (371° C.) or greater. If such a feedstock is exposed to a process with 30% conversion relative to a 700° F. (371° C.) conversion temperature, the resulting product would include 72 wt % of components boiling below 700° F. (371° C.) and 28 wt % of components boiling above 700° F. (371° C.).

Feedstocks

A wide range of petroleum and chemical feedstocks can be processed in accordance with the invention. Suitable feedstocks include whole and reduced petroleum crudes, atmospheric, cycle oils, gas oils, including vacuum gas oils and coker gas oils, light to heavy distillates including raw virgin distillates, hydrocrackates, hydrotreated oils, slack waxes, Fischer-Tropsch waxes, raffinates, and mixtures of these materials. Other suitable feedstocks can include atmospheric resids, vacuum resids, cracked feedstocks such as steam cracker tar, and other feedstocks having a boiling range of 400° F. (204° C.) to 1500° F. (816° C.), preferably 650° F. (343° C.) to 1200° F. (~650° C.). The above boiling ranges can represent an initial boiling point and a final boiling point, or the above boiling ranges can represent a T5 boiling point and a T95 boiling point.

One way of defining a feedstock is based on the boiling range of the feed. One option for defining a boiling range is to use an initial boiling point for a feed and/or a final boiling point for a feed. Another option is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil. Boiling points, including fractional weight boiling points, can be determined using a suitable ASTM method, such as ASTM D2887 or ASTM D7169.

The feed can have a sulfur content of 500 wppm to 50000 wppm or more, or 2000 wppm to 50000 wppm, or 5000 wppm to 30000 wppm. Additionally or alternately, the nitrogen content of such a feed can be 250 wppm to 5000 wppm, or 500 wppm to 3500 wppm. In some aspects, the feed can correspond to a "sweet" feed, so that the sulfur content of the feed is 10 wppm to 500 wppm and/or the nitrogen content is 1 wppm to 100 wppm.

In some embodiments, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus *Jatropha*. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

In various aspects, suitable feeds can have a relatively high aromatic content. For example, the total aromatic content of the 650° F.+ portion of a feedstock can be 30 wt % to 90 wt %, or 30 wt % to 80 wt %, or 40 wt % to 70 wt %. With regard to paraffin content, some feeds can have a relatively low 650° F.+ paraffin content, such as 1.0 wt % to 10.0 wt %, or 1.5 wt % to 8.0 wt %, or 2.0 wt % to 7.5 wt %. Other feeds can have a higher 650° F.+ paraffin content, such as 10 wt % to 70 wt %, or 30 wt % to 70 wt %, or 30 wt % to 60 wt %. With regard to naphthene content, some naphthenic crudes can have a 650° F.+ naphthene content of 30 wt % to 80 wt %, or 40 wt % to 70 wt %. For feeds with higher 650° F.+ paraffin and/or naphthene content, the aromatics content may be lower, such as 5 wt % to 60 wt %, or 10 wt % to 40 wt %, or 5 wt % to 30 wt %. In some aspects, a suitable feed can have a hydrogen content of 10.0 wt % to 14.0 wt %, or 10.5 wt % to 13.5 wt %.

In some aspects, the feedstock can be high in metals content, such as total nickel, vanadium and iron contents.

For example, a feedstock can contain at least 0.00001 grams of Ni/V/Fe (10 wppm), or at least 0.00005 grams of Ni/V/Fe (50 wppm), and up to 0.0002 grams of Ni/V/Fe (200 wppm) or more per gram of feedstock, on a total elemental basis of nickel, vanadium and iron.

Hydroprocessing of Heavy Aromatic Feedstocks

Examples of suitable processes for forming a hydroprocessed effluent can be hydrotreatment processes and optionally catalytic dewaxing processes. Hydrotreatment can be used to reduce the sulfur, nitrogen, and/or metals content of a feedstock with a reduced or minimized amount of feed conversion relative to 700° F. (371° C.). Optionally, if the metal content of a feedstock is sufficiently high, a demetallization process can be performed prior to hydrotreatment. Catalytic dewaxing can be used to improve various properties of a hydrotreated feedstock, such as cold flow properties. Additionally or alternately, the hydrotreated feedstock can be dewaxed by solvent dewaxing. Optionally, dewaxing can be performed on the raffinate from an extraction process instead of or in addition to performing dewaxing on a hydrotreated effluent prior to extraction. After hydrotreating, a gas-liquid separator may be used to remove gas phase contaminants from the liquid effluent at one or more locations within the process flow.

The hydroprocessing described herein can be performed in any convenient manner. The description below provides conditions for performing fixed bed processing of a feed. It is understood, however, that other types of hydroprocessing reactors can be used for one or more of the hydroprocessing steps or stages described herein. Examples of other types of hydroprocessing reactors include slurry reactors and ebullating bed reactors. As an example, if it is desired to perform demetallization on a feed prior to hydrotreatment, the demetallization can be performed under slurry hydrodemetallization conditions. The resulting effluent from the demetallization can then be processed under fixed bed hydrotreatment, ebullating bed hydrotreatment, or slurry hydrotreatment conditions, depending on the configuration.

Hydrotreatment is typically used to reduce the sulfur, nitrogen, and/or aromatic content of a feed. Hydrotreating conditions can also be suitable for removing metals from a feedstock. Hydrotreating conditions can include temperatures of 300° C. to 450° C., or 315° C. to 425° C.; pressures of 400 psig (2.8 MPa) to 1500 psig (10.3 MPa) or 500 psig (3.4 MPa) to 1200 psig (8.2 MPa); Liquid Hourly Space Velocities (LHSV) of 0.2-2.0 $h^{-1}$, or 0.3-1.5 $h^{-1}$; and hydrogen treat rates of 200 scf/B (~36 $m^3/m^3$) to 20,000 scf/B (~3600 $m^3/m^3$), or 500 (~89 $m^3/m^3$) to 10,000 scf/B (~1800 $m^3/m^3$).

Hydrotreating catalysts are typically those containing Group VIB metals, such as molybdenum and/or tungsten, and non-noble Group VIII metals, such as, iron, cobalt and nickel and mixtures thereof. These metals or mixtures of metals are typically present as oxides or sulfides on refractory metal oxide supports. Suitable metal oxide supports include low acidic oxides such as silica, alumina or titania. Preferred aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support. Preferred metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina. Alternatively, the hydrotreating catalyst can be a bulk metal catalyst, or a combination of stacked beds of supported and bulk metal catalyst.

After hydrotreatment, the resulting hydrotreated effluent can have reduced contents of sulfur, nitrogen, and/or metals. For example, the sulfur content of a hydrotreated effluent can be 1 wppm to 1000 wppm, or 1 wppm to 500 wppm, or 1 wppm to 100 wppm. Additionally or alternately, the nitrogen content of a hydrotreated effluent can be 1 wppm to 2000 wppm, or 500 wppm to 2000 wppm, or 1 wppm to 1200 wppm. Optionally, the hydrotreating conditions can be sufficient to generate a relatively "sweet" hydrotreating effluent having a sulfur content of 1 wppm to 500 wppm and a nitrogen content of 1 wppm to 100 wppm. Additionally or alternately, the metals content of a hydrotreated effluent can be 1 wppm to 10 wppm, or 1 wppm to 5 wppm, or 3 wppm to 10 wppm.

In various aspects, the reaction conditions in the reaction system can be selected to reduce or minimize conversion of a feed while still achieving desired targets for sulfur and/or nitrogen removal. Conversion of the feed can be defined in terms of conversion of molecules that boil above a temperature threshold to molecules below that threshold. The conversion temperature can be any convenient temperature, such as 700° F. (371° C.). Suitable amounts of conversion of molecules boiling above 700° F. to molecules boiling below 700° F. include converting 1 wt % to 15 wt % of the 700° F.+ portion of the feedstock, or 1 wt % to 10 wt %, or 1 wt % to 5 wt %.

In some embodiments, a dewaxing catalyst can also be included as part of the process train prior to solvent extraction, or the raffinate from solvent extraction can be catalytically dewaxed, or a combination thereof. Optionally, a separation can be performed on the hydrotreated effluent prior to dewaxing, so that $H_2S$ and $NH_3$ generated during hydrotreating can be removed from the feed that is exposed to the dewaxing catalyst. In some aspects, it can be beneficial to perform sufficient hydrotreating to produce a relatively sweet hydrotreated effluent prior to dewaxing.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from 20:1 to 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the disclosure are catalysts with a low ratio of silica to alumina. For example, for ZSM-48, the ratio of silica to alumina in the zeolite can be less than 200:1, or less than 110:1, or less than 100:1, or less than 90:1, or less than 80:1. In various embodiments, the ratio of silica to alumina can be from 30:1 to 200:1, or 60:1 to 110:1, or 70:1 to 100:1.

In various embodiments, the catalysts according to the disclosure can further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the disclosure can also include a binder. In some optional embodiments, the dewaxing catalysts used in process according to the disclosure can be formulated using a low surface area binder, a low surface area binder represents a binder with a surface area of 100 $m^2/g$ or less, or 80 $m^2/g$ or less, or 70 $m^2/g$ or less.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone can include a temperature of from 200 to 450° C., preferably 270 to 400° C., a hydrogen partial pressure of from 1.8 to 34.6 mPa (250 to 5000 psi), preferably 4.8 to 20.8 mPa, a liquid hourly space velocity of from 0.2 to 10 v/v/hr, preferably 0.5 to 3.0, and a hydrogen circulation rate of from 35.6 to 1781 $m^3/m^3$ (200 to 10,000 scf/B), preferably 178 to 890.6 $m^3/m^3$ (1000 to 5000 scf/B). In still other embodiments, the conditions can include temperatures in the range of 600° F. (343° C.) to 815° F. (435° C.), hydrogen partial pressures of from 500 psig to 3000 psig (3.5 MPag-20.9 MPag), and hydrogen treat gas rates of from 213 $m^3/m^3$ to 1068 $m^3/m^3$ (1200 SCF/B to 6000 SCF/B).

Solvent Processing of Hydrotreated Effluent

After hydrotreatment, the hydrotreated effluent can be separated in a separation stage comprising one or more separators, fractionators, flash drums, and/or other separation devices. The separation stage can allow for production of one or more lower boiling range fractions and a bottoms fraction. The bottoms fraction of the hydrotreated effluent (or at least a portion of the bottoms fraction) can then be solvent extracted. The one or more lower boiling range fractions can include one or more light ends fraction, one or more naphtha boiling range fractions, one or more kerosene boiling range fractions, and/or one or more diesel boiling range fractions.

Solvent extraction can be performed on the bottoms portion separated out from the hydrotreated effluent. Solvent extraction can be used to reduce the aromatics content and/or the amount of polar molecules. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. Other potential extraction solvents can include sulfolane and $SO_2$. By controlling the solvent used for extraction, the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the deasphalted oil, the raffinate phase can have an aromatics content of 2 wt % to 30 wt %, or 2 wt % to 20 wt %.

In some aspects, the raffinate from the solvent extraction can be under-extracted. In such aspects, the extraction is carried out under conditions such that the raffinate yield is increased or maximized while still removing most of the lowest quality molecules from the feed. Raffinate yield may be increased or maximized by controlling extraction conditions, for example, by lowering the solvent to oil treat ratio and/or decreasing the extraction temperature. In various aspects, the raffinate yield from solvent extraction can be at least about 25 wt %, or at least about 40 wt %, or at least about 60 wt %.

After extraction, the raffinate from solvent extraction can optionally be dewaxed. The raffinate can be catalytically dewaxed as described above and/or solvent dewaxed. Solvent dewaxing typically involves mixing a feed with chilled dewaxing solvent to form an oil-solvent solution. Precipitated wax is thereafter separated by, for example, filtration. The temperature and solvent are selected so that the oil is dissolved by the chilled solvent while the wax is precipitated.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. per minute, usually between about 1 to about 5° F. per minute. The final temperature of the oil-solvent/precipitated wax mixture in the cooling tower will usually be between 0 and 50° F. (−17.8 to 10° C.). The mixture may then be sent to a scraped surface chiller to separate precipitated wax from the mixture.

Representative dewaxing solvents are aliphatic ketones having 3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added can be sufficient to provide a liquid/solid weight ratio between the range of 5/1 and 20/1 at the dewaxing temperature and a solvent/oil volume ratio between 1.5/1 to 5/1. The solvent dewaxed oil is typically dewaxed to an intermediate pour point, preferably less than about +10° C., such as less than about 5° C. or less than about 0° C., such as −15° C. or possibly lower. The resulting solvent dewaxed oil is suitable for use in forming one or more types of Group I base oils. The aromatics content will typically be greater than 10 wt % in the solvent dewaxed oil. Additionally, the sulfur content of the solvent dewaxed oil will typically be greater than 300 wppm.

Processing Configuration

FIG. 1 schematically shows an example of a processing configuration for producing upgraded raffinate and extract products. In FIG. 1, a feed 105 is passed into a vacuum pipestill or another type of fractionator 110 that is suitable for generating a feed fraction 115 having a desired boiling range. The feed fraction 115 having the desired boiling range is then passed into one or more hydroprocessing reactors 120 for hydrotreatment to form a hydrotreated effluent 125. The hydrotreated effluent can have reduced or minimized amounts of sulfur, nitrogen, and/or metals, such as less than 1000 wppm of sulfur and 3-10 wppm of metals. Optionally, the hydroprocessing reactors 125 can also be used to perform dewaxing on the feed fraction 115. The hydrotreated effluent 125 (which may also optionally be dewaxed) can then be solvent extracted 130 to form a raffinate 133 and an extract 137. Optionally, the raffinate can undergo further processing such as solvent dewaxing 140 (or alternatively catalytic dewaxing). Optional solvent dewaxing 140 can produce a dewaxed raffinate 145 and a residual wax product 147.

Feed Flexibility—Relationships Between Feed Types and Product Types

The configurations described herein can be used to process a variety of types of feeds. The nature of the raffinate and extract products can be dependent on the nature of the type of feed.

One example of a feed can be a crude that is suitable for production of Group I lubricant base oils. For this type of feed, an initial fractionation can be performed to separate out a fraction having an initial or T5 boiling point of at least about 650° F. (343° C.), and a final or T95 boiling point of about 1200° F. (~650° C.) or less. The separated fraction can then be hydrotreated under selective hydroprocessing conditions, such as a pressure of 500 psig (3.4 MPa) to 1200 psig (8.2 MPa), an LHSV of 0.3 $hr^{-1}$ to 1.5 $hr^{-1}$, and a temperature of 300° C. to 450° C. The selective hydroprocessing conditions can be suitable for conversion of about 10% or less of the feed relative to a conversion temperature of 700° F. (371° C.). The bottoms portion (such as a 343° C.+ portion) of the hydroprocessed effluent can then be solvent extracted to form a raffinate portion and an extract portion. The solvent extraction conditions can be selected to produce a raffinate portion having a viscosity index that is 40-60 greater than the viscosity index of the hydrotreated effluent. The raffinate portion can correspond to an upgraded Group I lubricant base oil with less than 10 wppm of metals and less than 1000 wppm of sulfur. Optionally, the raffinate portion can be solvent dewaxed to provide further VI uplift. The extract portion can correspond to an upgraded extract having less than 10 wppm of metals and less than 1000 wppm of sulfur.

Another example of a feed can be a paraffinic crude. For this type of feed, an initial fractionation can be performed to separate out a fraction having an initial or T5 boiling point of at least about 650° F. (343° C.), and a final or T95 boiling point of about 1200° F. (~650° C.) or less. Because the initial feed is a paraffinic crude, the 650° F.+ portion of the feed can have a paraffin content of 30 wt % to 70 wt %. The separated fraction can then be hydrotreated under selective hydroprocessing conditions, such as a pressure of 500 psig (3.4 MPa) to 1200 psig (8.2 MPa), an LHSV of 0.3 $hr^{-1}$ to 1.5 $hr^{-1}$, and a temperature of 300° C. to 450° C. The selective hydroprocessing conditions can be suitable for conversion of about 10% or less of the feed relative to a conversion temperature of 700° F. (371° C.). The bottoms portion (such as a 343° C.+ portion) of the hydroprocessed effluent can then be solvent extracted to form a raffinate portion and an extract portion. The raffinate portion can correspond to an upgraded Group I lubricant base oil with less than 10 wppm of metals and less than 1000 wppm of sulfur. Optionally, the raffinate portion can be solvent dewaxed to provide further VI uplift. The extract portion can correspond to an upgraded extract having less than 10 wppm of metals and less than 1000 wppm of sulfur. The upgraded extract can be suitable for use as a process oil.

Still another example of a feed can be a naphthenic crude. For this type of feed, an initial fractionation can be performed to separate out a fraction having an initial or T5 boiling point of at least about 650° F. (343° C.), and a final or T95 boiling point of about 1200° F. (~650° C.) or less. Because the initial feed is a naphthenic crude, the 650° F.+ portion of the feed can have a naphthene content of 30 wt % to 70 wt %. The separated fraction can then be hydrotreated under selective hydroprocessing conditions, such as a pressure of 500 psig (3.4 MPa) to 1200 psig (8.2 MPa), an LHSV of 0.3 $hr^{-1}$ to 1.5 $hr^{-1}$, and a temperature of 300° C. to 450° C. The selective hydroprocessing conditions can be suitable for conversion of about 10% or less of the feed relative to a conversion temperature of 700° F. (371° C.). The bottoms portion (such as a 343° C.+ portion) of the hydroprocessed effluent can then be solvent extracted to form a raffinate portion and an extract portion. The raffinate portion can correspond to a treated distillate aromatic extract (TDAE) with less than 10 wppm of metals and less than 1000 wppm of sulfur. Additionally, the TDAE can have a polyaromatic hydrocarbon content of less than 3.0 wt %, or less than 2.5 wt %, or less than 2.0 wt % or less than 1.5 wt %. In particular, the TDAE can have a polyaromatic hydrocarbon content of 0.1 wt % to 3.0 wt %, or 0.1 wt % to 2.0 wt %, or 0.1 wt % to 1.5 wt %. The extract portion can correspond to an upgraded aromatic feed that is suitable for, for example, carbon fiber production.

EXAMPLES

The following examples are based on modeling of processing various crude fractions in a configuration similar to the configuration in FIG. 1. The processes were modeled using an empirical model based on both commercial and laboratory scale data.

Three types of initial feeds were modeled as being processed in the configuration in FIG. 1. A first feed A corresponded to a feed similar to a 700° F.-1125° F. (371° C.-607° C.) fraction of a bitumen derived from tar sands. The second and third feeds (B and C) corresponded to 700° F.+ (371° C.) fractions of blends of the bitumen with other crudes. It is noted that Feed A corresponds to a highly aromatic crude, while Feed C corresponds to a crude containing more naphthenes than aromatics. Table 1 provides additional information regarding the initial feed characteristics.

TABLE 1

| Initial Feed Characteristics | | | |
|---|---|---|---|
| | Feed A | Feed B | Feed C |
| Hydrogen content (wt %) | 11.2 | 12.2 | 12.4 |
| API Gravity | 10.7 | 17.7 | 18.8 |
| Total Sulfur (wt %) | 4.1 | 1.7 | 2.3 |
| Total Nitrogen (wppm) | 3100 | 1900 | 1700 |
| Total Aromatics (wt %) | 82.0 | 59.6 | 48.4 |
| Total Paraffins (wt %) | 1.7 | 7.2 | 2.2 |
| Total Naphthenes (wt %) | 16.3 | 33.2 | 49.4 |
| D2887 IBP (° F.) | 730 | 722 | 717 |
| 5 wt % | 785 | 772 | 753 |
| 20 wt % | 857 | 845 | 818 |
| 30 wt % | 888 | 874 | 846 |
| 50 wt % | 938 | 925 | 896 |
| 70 wt % | 990 | 978 | 951 |
| 90 wt % | 1054 | 1047 | 1027 |
| 95 wt % | 1079 | 1074 | 1059 |
| FBP (° F.) | 1125 | 1123 | 1115 |

In the modeled process, the feeds in Table 1 were hydrotreated in the presence of a commercially available NiMo supported catalyst under conditions selected to reduce the sulfur content of the 650° F.+ (343° C.) portion of the effluent to 1000 wppm. Each feed was processed at three different pressure conditions, corresponding to a pressure of about 700 psig, about 1000 psig, and about 1300 psig, with the temperature adjusted accordingly to achieve the desired sulfur target. The LHSV was about 0.9 $hr^{-1}$. This resulted in weighted average bed temperatures of 380° C. to 400° C. for Feed A, 355° C. to 365° C. for Feed B, and 355° C. to 365° C. for Feed C. Under these conditions, 10-13% of Feed A was converted relative to 700° F. (371° C.), 3-4% of Feed B was converted, and 4-5% of Feed C was converted.

The hydrotreated effluent was then fractionated to generate fractions including a light ends fraction, a naphtha boiling range fraction, a diesel boiling range fraction, and a bottoms fraction. The fractionation was modeled to have a roughly 600° F. (316° C.) cut point for forming the bottoms. The resulting bottoms fraction characteristics shown in Table 2 reflect the expected boiling point profile that would be produced from a typical fractionation. Table 2 shows the bottoms fractions generated by hydrotreatment of Feed A at ~400° C. and ~700 psig (~4.8 MPa); Feed B at 360° C. and ~1000 psig (~6.8 MPa); and Feed C at ~355° C. and ~1300 psig (~8.9 MPa).

TABLE 2

| Hydrotreated Effluent Bottoms | | | |
|---|---|---|---|
| | Feed A | Feed B | Feed C |
| Hydrogen content (wt %) | 12.1 | 12.7 | 13.1 |
| API Gravity | 20.0 | 22.1 | 24.4 |
| Total Sulfur (wt %) | <0.1 | <0.1 | <0.1 |
| Total Nitrogen (wppm) | ~1650 | ~1100 | ~750 |
| Total Aromatics (wt %) | 72.7 | 53.6 | 41.2 |
| Total Paraffins (wt %) | 5.2 | 8.6 | 3.7 |
| Total Naphthenes (wt %) | 22.2 | 37.8 | 55.1 |
| D2887 IBP (° F.) | 481 | 586 | 560 |
| 5 wt % | 613 | 738 | 727 |

TABLE 2-continued

| Hydrotreated Effluent Bottoms | | | |
|---|---|---|---|
| | Feed A | Feed B | Feed C |
| 10 wt % | 710 | 774 | 753 |
| 20 wt % | 786 | 818 | 791 |
| 30 wt % | 831 | 852 | 827 |
| 50 wt % | 892 | 905 | 872 |
| 70 wt % | 948 | 955 | 917 |
| 90 wt % | 1022 | 1026 | 990 |
| 95 wt % | 1052 | 1056 | 1022 |
| FBP (° F.) | 1114 | 1109 | 1091 |

Table 2 shows that the hydrotreating conditions were effective for reducing the sulfur content to a desired target (1000 wppm or less) while performing only a modest amount of aromatic saturation relative to the initial feed. Reducing or minimizing aromatic saturation can be beneficial for maintaining low costs when performing hydrotreatment on a feed with high aromatic content. Additionally, for applications involving an aromatic extract, the reduced or minimized amount of aromatic saturation can preserve the desired aromatics for the eventual extract fraction. It is also noted that even though only a modest amount of aromatic saturation was performed, the hydrotreatment resulted in a substantial increase in the API Gravity for each feed.

The hydrotreated effluent bottoms shown above were then extracted in the model. The extractor in the model had 5 theoretical stages. The extraction was performed at an extractor bottom temperature of 70° C. using a ratio of solvent to feed of 1.5, with n-methylpyrollidone as the solvent. Under these conditions, the raffinate yield was 29 wt % for Feed A, 54 wt % for Feed B, and 73 wt % for Feed C. These yield differences are believed to reflect the different initial compositions of Feeds A, B, and C. Feed A is highly aromatic, and therefore the extract product is the majority product for Feed A. Feed C is a naphthenic feed, and therefore the raffinate product is the majority product for Feed C.

Solvent dewaxing was then modeled for the raffinate products. The solvent dewaxing process conditions included using a ketone solvent. The conditions were selected to achieve a −9° C. pour point for the dewaxed raffinate.

Tables 3 and 4 show details for the characteristics of the final extract product (Table 3) and the final dewaxed raffinate product (Table 4) for each of the initial feeds.

TABLE 3

| Extract Product | | | |
|---|---|---|---|
| | Feed A | Feed B | Feed C |
| Hydrogen content (wt %) | 11 | 11 | 12 |
| API Gravity | 13 | 12 | 14 |
| Total Sulfur (wt %) | <0.1 | <0.1 | <0.1 |
| Total Nitrogen (wppm) | ~3000 | ~3800 | ~4200 |
| Total Aromatics (wt %) | 91.1 | 85.9 | 80.6 |
| 1-Ring Aromatics (wt %) | 20.7 | 21.6 | 25.1 |
| 2-Ring Aromatics (wt %) | 40.2 | 30.4 | 29.7 |
| 3-Ring Aromatics (wt %) | 12.2 | 14.9 | 9.9 |
| 4-Ring Aromatics (wt %) | 18.0 | 19.0 | 15.9 |
| Total Paraffins (wt %) | 1.5 | 1.7 | 0.4 |
| Total Naphthenes (wt %) | 6.2 | 10.1 | 17.1 |
| D2887 0.5 wt % (° F./° C.) | 804/429 | 804/429 | 801/427 |
| 5 wt % | 844/451 | 840/449 | 833/445 |
| 10 wt % | 862/461 | 858/459 | 853/456 |
| 30 wt % | 903/484 | 898/481 | 892/478 |
| 50 wt % | 934/501 | 928/498 | 919/493 |
| 70 wt % | 963/517 | 961/516 | 952/511 |

TABLE 3-continued

| Extract Product | Feed A | Feed B | Feed C |
|---|---|---|---|
| 90 wt % | 1008/542 | 1006/541 | 997/536 |
| 95 wt % | 1026/552 | 1024/551 | 1017/547 |
| 99.5 wt % (° F./° C.) | 1071/577 | 1071/577 | 1063/573 |

As shown in Table 3, the resulting extract products include at least 70 wt % aromatics, or at least 80 wt % aromatics (such as up to 95 wt % aromatics), even for the extract formed from a naphthenic feed. The extract products also include less than 20 wt % (15 wt % to 20 wt %) of 4-ring aromatics and less than 15 wt % (5 wt % to 15 wt %) of 3-ring aromatics. Additionally, the extract products from Feeds B and C have a total naphthene content of at least 10 wt %, or at least 15 wt %. In particular, the napthene content can be 10 wt % to 20 wt %, or 10 wt % to 15 wt %, or 15 wt % to 20 wt %.

Additionally or alternately, the extract products include from 2900 to 4200 wppm of nitrogen. It is noted that the yield of raffinate was substantially higher for Feed C than for Feed A. As a result, even though the nitrogen content of the hydrotreated bottoms product for feed C was relatively low, substantially all of that nitrogen was concentrated in compounds that became part of the extract fraction, resulting in a relatively high nitrogen content in the extract.

TABLE 4

| Solvent Dewaxed Raffinate Product | Feed A | Feed B | Feed C |
|---|---|---|---|
| Hydrogen content (wt %) | 13.6 | 13.5 | 13.6 |
| API Gravity | 29 | 28 | 28 |
| Total Sulfur (wt %) | <0.1 | <0.1 | <0.1 |
| Total Nitrogen (wppm) | 4 | 21 | 19 |
| Total Aromatics (wt %) | 26.3 | 25.1 | 19.6 |
| Total Paraffins (wt %) | 11.8 | 16.7 | 6.1 |
| Total Naphthenes (wt %) | 61.9 | 58.2 | 74.2 |
| 1-Ring Naphthenes (wt %) | 20.8 | 16.6 | 27.6 |
| 2-Ring Naphthenes (wt %) | 24.3 | 21.8 | 24.7 |
| 3-Ring Naphthenes (wt %) | 9.5 | 10.1 | 14.4 |
| 4+-Ring Naphthenes (wt %) | 7.4 | 9.6 | 7.5 |
| D2887 0.5 wt % (° F./° C.) | 680/360 | 698/370 | 698/370 |
| 5 wt % | 721/383 | 736/391 | 731/388 |
| 10 wt % | 738/392 | 748/398 | 738/392 |
| 30 wt % | 779/415 | 783/417 | 772/411 |
| 50 wt % | 804/429 | 804/429 | 801/427 |
| 70 wt % | 829/443 | 829/443 | 822/439 |
| 90 wt % | 858/459 | 858/459 | 856/458 |
| 95 wt % | 869/465 | 869/465 | 869/465 |
| 99.5 wt % (° F./° C.) | 885/474 | 885/474 | 883/473 |

As shown in Table 4, the resulting dewaxed raffinate product includes at least 55 wt % naphthenes (55 wt % to 80 wt %, or 60 wt % to 75 wt %), while still having a pour point of −9° C. The dewaxed raffinate products also include at least 6 wt % (6 wt % to 15 wt %) of 4+-ring naphthenes and less than 17 wt % (9 wt % to 17 wt %) of 3-ring naphthenes. Additionally, the raffinate products derived from Feeds A and C include less than 8 wt % of 4+-ring naphthenes (6 wt % to 8 wt %).

In addition to the above, when the initial feed has an aromatic content of less than about 50 wt %, the resulting raffinate product can have an aromatics content of about 2 wt % to about 20 wt %. This is shown, for example, by the raffinate product derived from Feed C.

Additionally or alternately, a raffinate product, either prior to or after solvent dewaxing, can have a reduced or minimized nitrogen content, such as 50 wppm or less, or 25 wppm or less. In some aspects, the nitrogen content of the raffinate (prior to and/or after solvent dewaxing) can be still lower, such as 10 wppm or less. Additionally or alternately, for an initial feed with a low nitrogen content, such as an initial feed with a nitrogen content of 1000 wppm or less, the nitrogen content can be 10 wppm or less. In particular, the nitrogen content of the raffinate, prior to and/or after solvent dewaxing, can be 0.1 wppm to 50 wppm, or 0.1 wppm to 25 wppm, or 0.1 wppm to 10 wppm.

ADDITIONAL EMBODIMENTS

Embodiment 1

A method for forming a raffinate and an extract, comprising: hydrotreating a feedstock having a T5 boiling point of at least 400° F. (~204° C.), or at least 650° F. (~343° C.), and a T95 boiling point of 1500° F. (~816° C.) or less, or 1200° F. (~649° C.) or less, under hydrotreating conditions comprising less than 15% feed conversion (or less than 10% feed conversion) relative to a conversion temperature of 700° F. (~371° C.) to form a hydrotreated effluent, the feedstock having a 650° F.+ (~343° C.+) aromatics content of 25 wt % to 90 wt % (or 30 wt % to 90 wt %) and a sulfur content of greater than 1000 wppm, the hydrotreated effluent comprising a hydrotreated effluent fraction having a T5 boiling point of at least 400° F. (~204° C.), or at least 650° F. (~343° C.), an aromatics content of at least 10 wt %, a sulfur content of less than 1000 wppm, and a combined amount of Ni, V, and Fe of less than 10 wppm; and performing a solvent extraction on the hydrotreated effluent fraction to form at least a raffinate product having a nitrogen content of less than 50 wppm (or 25 wppm or less, or 10 wppm or less) and an extract product comprising at least 70 wt % aromatics.

Embodiment 2

The method of Embodiment 1, further comprising dewaxing at least a portion of the hydrotreated effluent fraction prior to performing the solvent extraction.

Embodiment 3

The method of any of the above embodiments, further comprising dewaxing at least a portion of the raffinate product.

Embodiment 4

The method of Embodiment 2 or 3, wherein the dewaxing comprises solvent dewaxing, catalytic dewaxing, or a combination thereof.

Embodiment 5

The method of any of the above embodiments, wherein the hydrotreating conditions comprise exposing the separated fraction to a hydrotreating catalyst at a pressure of 500 psig (~3.4 MPa) to 1200 psig (~8.2 MPa), a temperature of 300° C. to 450° C., and a LHSV of 0.1 to 5.0 $hr^{-1}$.

Embodiment 6

The method of any of the above embodiments, wherein the feedstock has a sulfur content of at least 2.0 wt % or at least 4.0 wt %.

Embodiment 7

The method of claim 1, wherein the feedstock has a 650° F.+ aromatics content of less than 50 wt %, the raffinate product having an aromatics content of 2 wt % to 20 wt %; or wherein the feedstock has a 650° F.+ (~343° C.) aromatics content of 50 wt % to 90 wt %, or 70 wt % to 90 wt %.

Embodiment 8

The method of any of the above embodiments, wherein the hydrotreated effluent fraction has a naphthene content of 30 wt % to 80 wt %, the extract product having a naphthene content of at least 10 wt %, or at least 15 wt %.

Embodiment 9

The method of any of the above embodiments, wherein the feedstock has a nitrogen content of less than 1000 wppm, and wherein the extract product has a nitrogen content of less than 1000 wppm.

Embodiment 10

A raffinate product having a pour point of 0° C. or less (or ~9° C. or less) comprising at least 55 wt % of total naphthenes, 6 wt % to 15 wt % of 4+-ring naphthenes, less than 1000 wppm of sulfur, less than 50 wppm of nitrogen, and less than 3.0 wt % of polycyclic aromatics.

Embodiment 11

The raffinate product of Embodiment 10, the raffinate product having a metals content of less than 10 wppm.

Embodiment 12

The raffinate product of Embodiment 10 or 11, the raffinate product comprising 2 wt % to 20 wt % of total aromatics.

Embodiment 13

The raffinate product of any of Embodiments 10-12, wherein the raffinate product comprises 9 wt % to 17 wt % of 3-ring naphthenes, 6 wt % to 8 wt % of 4+-ring naphthenes, or wherein the raffinate product comprises 60 wt % to 75 wt % of total naphthenes, or a combination thereof.

Embodiment 14

An extract product comprising at least 70 wt % aromatics, 15 wt % to 20 wt % of 4-ring aromatics, less than 15 wt % of 3-ring aromatics, and less than 1000 wppm of sulfur, the extract product having a T5 boiling point of at least 400° C., and a T95 boiling point of 560° C. or less, the extract product optionally having a metals content of less than 10 wppm, the extract product optionally having a total naphthene content of 10 wt % to 20 wt %.

Embodiment 15

The extract product of Embodiment 14, the extract product having a nitrogen content of less than 1000 wppm, or less than 500 wppm.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A raffinate product having a pour point of 0° C. or less comprising 6.1 wt % to 11.8 wt % of total paraffins, about 60 wt % to about 75 wt % of total naphthenes, 6 wt % to 15 wt % of 4+-ring naphthenes, less than 1000 wppm of sulfur, less than 50 wppm of nitrogen, 2 wt % to 30 wt % of total aromatics and less than 3.0 wt % of polycyclic aromatics.

2. The raffinate product of claim 1, wherein the raffinate product has a metals content of less than 10 wppm.

3. The raffinate product of claim 1, the raffinate product comprising 2 wt % to 20 wt % of total aromatics.

4. The raffinate product of claim 1, wherein the raffinate product comprises 9 wt % to 17 wt % of 3-ring naphthenes, and 6 wt % to 8 wt % of 4+-ring naphthenes.

5. The raffinate product of claim 1, wherein the raffinate product has a pour point of −9° C. or less.

* * * * *